United States Patent [19]

Bollinger

[11] Patent Number: 4,882,859

[45] Date of Patent: Nov. 28, 1989

[54] EXCAVATING BUCKET HAVING SCOOPS

[75] Inventor: Karl Bollinger, Rueil Malmaison, France

[73] Assignee: Soletanche, Nanterre, France

[21] Appl. No.: 262,443

[22] Filed: Oct. 25, 1988

[30] Foreign Application Priority Data

Nov. 5, 1987 [FR] France ..... 87 15355

[51] Int. Cl.[4] ..... B66C 3/02

[52] U.S. Cl. ..... 37/187; 414/722

[58] Field of Search ..... 37/183 R, 183 A, 184–188; 414/722, 725, 726, 738–739

[56] References Cited

U.S. PATENT DOCUMENTS

| | | | |
|---|---|---|---|
| 787,022 | 4/1905 | Bode et al. | 37/187 |
| 1,026,573 | 5/1912 | Ellingen | 37/187 |
| 1,400,922 | 12/1921 | Williams | 37/187 |
| 2,501,594 | 3/1950 | Billings . | |
| 2,837,846 | 9/1958 | Long . | |

FOREIGN PATENT DOCUMENTS

| | | | |
|---|---|---|---|
| 1904454 | 8/1970 | Fed. Rep. of Germany | 37/187 |
| 63268 | 9/1952 | France . | |
| 1341446 | 12/1962 | France . | |
| 2026820 | 9/1969 | France . | |
| 2389723 | 5/1977 | France . | |

*Primary Examiner*—Eugene M. Eheickholt

*Attorney, Agent, or Firm*—Schweitzer & Cornman

[57] ABSTRACT

The invention relates to an excavating bucket including two scoops (13) mounted movably, with respect to a frame (1), from an open terrain-engaging position to a closed position in which they enclose a certain quantity of cuttings. It comprises a central bucket body (5), integral with said frame and including at least two lateral walls (6), the scoops being arranged so that, in closed position, they come toward the central body from both directions with their lateral walls extending from the lateral walls of the central body.

6 Claims, 3 Drawing Sheets

EXCAVATING BUCKET HAVING SCOOPS

BACKGROUND OF THE INVENTION

The present invention is related to an excavating bucket having scoops, and more particularly to such a bucket including two scoops, mounted movably, with respect to a frame, from an open terrain-engaging position, to a closed position in which they enclose a certain quantity of cuttings.

Such buckets are already well known and used, for example suspended from a "Kelly"-type guide, for digging trenches.

However, these known buckets have a certain number of disadvantages.

First of all, the angle of engagement of the picks mounted along the leading edges of the scoops is not generally optimal, so the penetration into the terrain is not always satisfactory.

In addition, it is desirable to optimize the closing force of the bucket in all the positions of the scoops, so as to obtain a maximal force of penetration of the picks.

Finally, it is desirable, for a bucket possessing a given weight, to obtain the widest possible opening of the bucket, as well as the greatest possible excavation volume per pass, so as to reduce the time required for a given job.

SUMMARY OF THE INVENTION

The present invention is intended to furnish an improved bucket permitting the above set of parameters to be optimized.

For this purpose, the object of the invention is an excavating bucket including two scoops, mounted movably, with respect to a frame, from an open terrain-engaging position, to a closed position in which they enclose a certain quantity of cuttings, characterized by the fact that it comprises a central bucket body, integral with said frame, and including at least two lateral walls, the scoops being arranged so that, in closed position, they come from both directions toward the central body with their lateral walls extending from the lateral walls of the central body.

Thus, for scoops of a given size, a greater excavation volume is available, because of the presence of the central body. When the bucket closes up, the scoops push the cuttings from both directions into this central body, and then the scoops close up, themselves enclosing a certain quantity of cuttings.

The central body, consisting essentially of two lateral walls, can moreover be rigidified by means of a knife-edge disposed at its lower part and forming a brace between its two lateral walls, the scoops being arranged so that in closed position, their leading edges meet in the vicinity of this knife-edge.

Moreover, in order to obtain an optimal angle of engagement, each scoop can be mounted pivotally on a support lever, itself mounted pivotally on the frame, closing means being provided to cause, when the bucket is closed, a rotation of the scoops with respect to their support levers during a first phase, and during a second phase, a rotation of the levers with respect to the frame.

This arrangement, which permits a greater opening of the bucket, permits in addition the central body to be well filled. Indeed, during the first phase of the closure, the scoops are filled while digging out essentially the edges of the trench. Then, during the second phase of operation, the scoops dig out the bottom of the trench while pushing the corresponding cuttings into the bucket body, because during this second phase, the axis of rotation of the scoops is displaced upward to the level of the articulation of the levers on the frame.

In a particular embodiment of the invention, the means of closing the bucket can comprise, for each scoop, a first cylinder mounted between the frame and the end of the respective lever opposite to the axis of rotation of the scoop, and a second cylinder mounted between the lever and the scoop.

Advantageously, an ejection ram can also be provided, arranged to slide from a high position when the bucket is closed, to a low position in the interior of the central body when the bucket is open.

This ram's function is to facilitate the ejection of the cuttings contained in the bucket, and more particularly in its central body, when the bucket is opened.

The movement of the ejection ram can be obtained by means of at least one rocker arm, of which a first end is mounted on one of the levers and of which the second end is mounted on the ejection ram, so as to cause the ram to rise when the lower part of the lever pivots in the direction of the central body in connection with the closing of the bucket.

More particularly, this rocker arm can have its first end mounted at the lower part of the lever and its second end mounted on the ejection ram, at a point that is situated above the first end when the bucket is open with the ram in its low position.

DESCRIPTION OF THE DRAWINGS

As a non-limiting example, one particular embodiment of the invention will now be described, with reference to the annexed schematic drawings, in which.

DETAILED DESCRIPTION OF THE DRAWINGS

Figure 1:
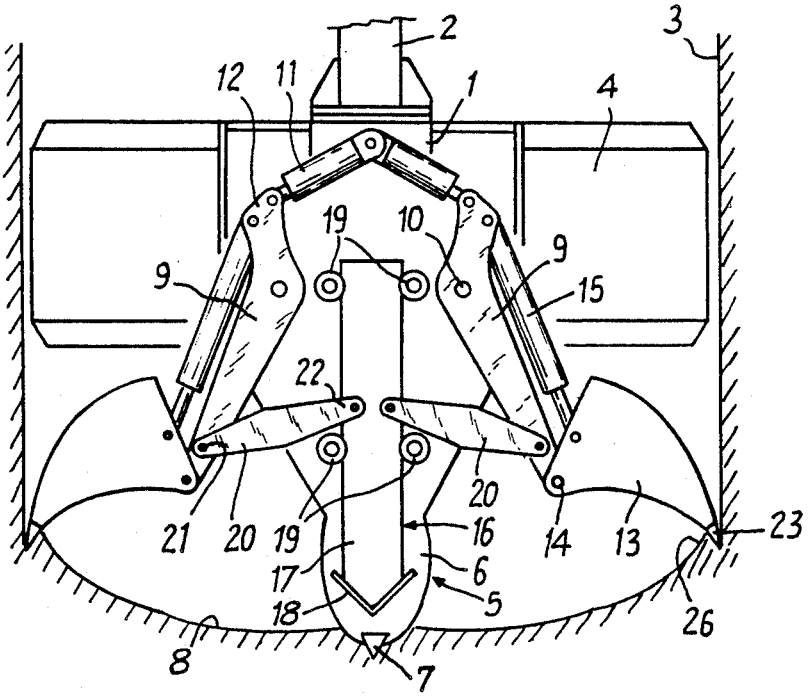
FIGS. 1–3 show a bucket according to the invention, seen in elevation in three successive operating positions.

The bucket according to the invention includes a frame 1, connected in the present case to a guide 2 of the "Kelly" type, permitting it to rise and descend in a trench 3, and equipped with lateral guides 4 permitting it to be guided in the trench.

A central bucket body 5, consisting essentially of two lateral walls 6, embodied in the form of metallic plates, is integral with the frame 1. Only one of these plates has been shown in FIGS. 1–3.

A knife-edge 7, facilitating the penetration of the bucket into the bottom 8 of the trench, forms a brace between the two walls 6.

Two levers 9 are mounted on the frame 1, articulated about horizontal axes 10. These levers are controlled by means of cylinders 11, whose bodies are mounted on the frame 1 and whose shafts are mounted on the upper ends 12 of the levers 9.

At the lower end of each lever 9, a scoop 13 is mounted pivotally about a horizontal axis 14. The position of this scoop with respect to its support lever is controlled by means of a cylinder 15 whose body is mounted on the upper end 12 of the lever 9 and whose shaft is mounted on the scoop 13.

A ram 16, formed by a vertical beam 17 having an I-shaped cross-section and an ejection tip 18, is mounted for sliding vertically between four horizontal rolls 19 mounted between the walls 6.

This ram is controlled by two rocker arms 20, each of these rocker arms having one of its ends 21 articulated at the lower end of the arm 9 and its other end 22 articulated on the beam 17.

When the bucket is in open position (FIG. 1) or in intermediate position (FIG. 2), that is, as will be seen hereinafter, when the lower parts of the levers 9 are remote from the axis of the bucket, the ends 22 of the levers 20 are higher then their ends 21.

Figure 5:
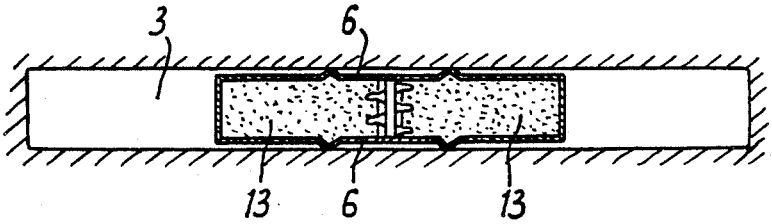
FIG. 5 is a cross-sectional view according to line V—V in FIG. 3.
Figure 6:
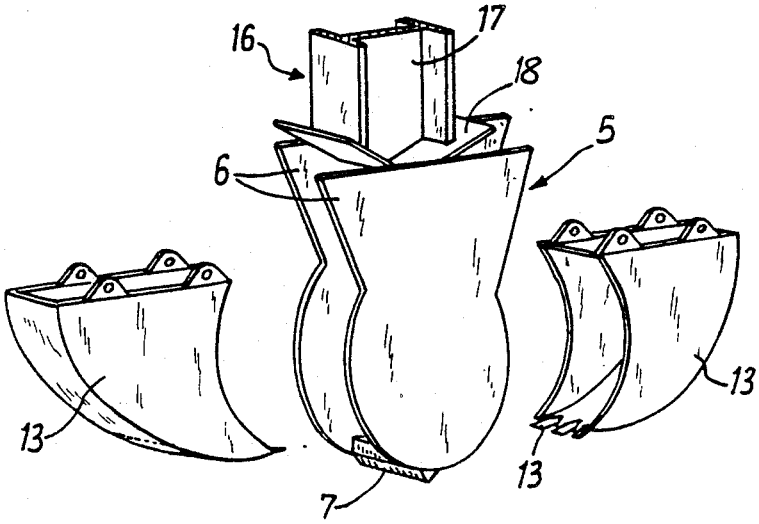
FIG. 6 is a perspective view of certain elements of this bucket.

Finally, the leading edges of the scoops 13 are provided with picks 23, and the free edges 24 of the lateral walls of these scoops have a shape complementary to that of the edges 25 of the walls 6, such that when the bucket is closed (FIGS. 3 and 5), the lateral walls of the scoops extend from the lateral walls 6 of the central body 5.

It will be noticed, finally, that in the present embodiment, the levers 9, as well as the rocker arms 20, are in fact double levers and double rocker arms.

The operation of the bucket according to the invention will now be described.

In FIG. 1 the bucket is seen in open position with the cylinders 11 and 15 retracted. Because the lower parts of the levers 9 are spread apart, the rocker arms 20 support the ram 16 in low position in the interior of the central body 5.

It is seen that in this position the picks 23 of the scoops engage the edges 26 of the trench substantially vertically.

Figure 2:
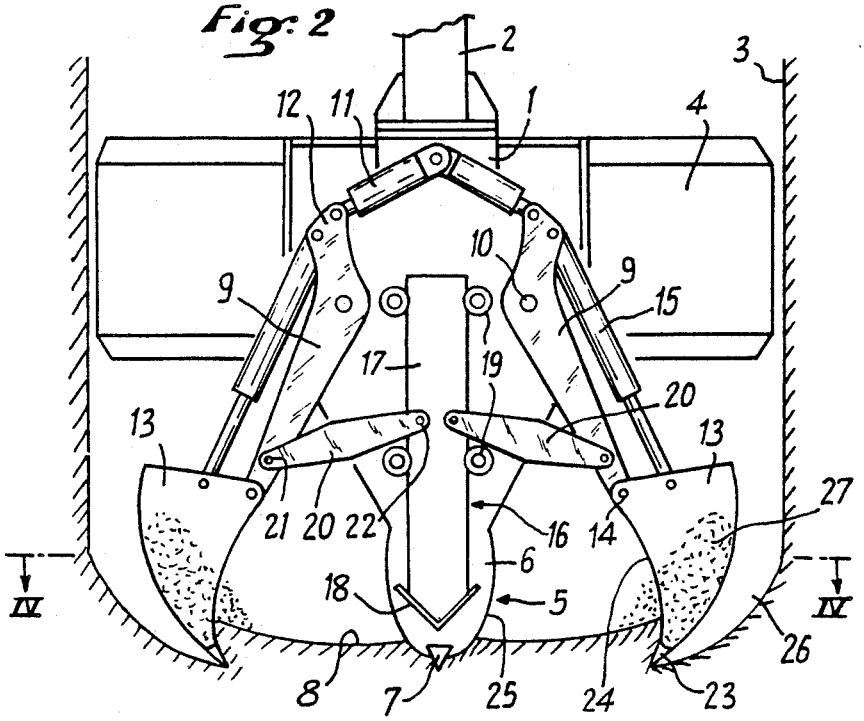

The cylinders 15 are then deployed, causing the scoops 13 to pivot about the axes 14 as shown in FIG. 2.

In this movement, the scoops 13 gather up the cuttings 27 removed from the edges 26 of the trench.

Figure 3:
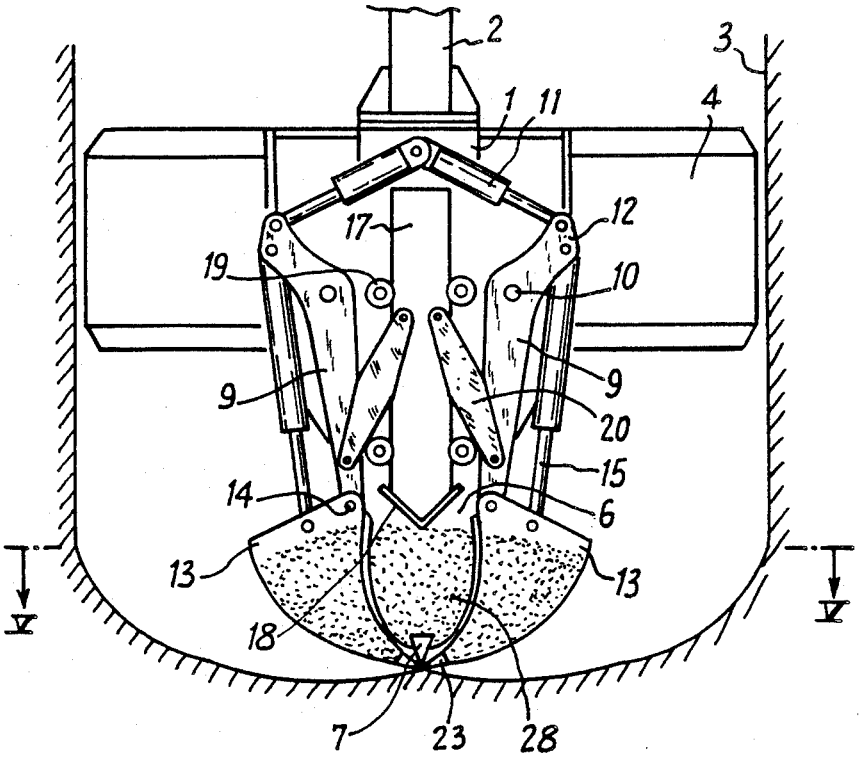
Figure 4:
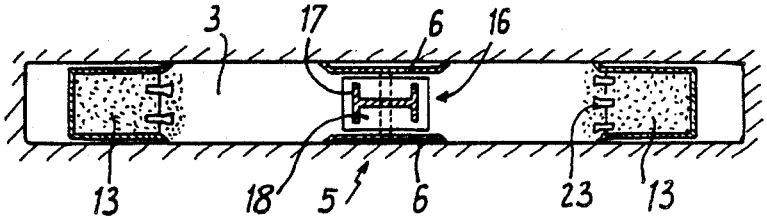
FIG. 4 is a cross-sectional view according to line IV—IV in FIG. 2.

Finally the cylinders 11 are deployed, to bring the bucket into its closed position shown in FIG. 3.

In this movement, the lower parts of the levers 9 are moved toward the axis of the bucket, such that the scoops 13 pivot about the axes 10. The scoops therefore push the cuttings 28 removed from the bottom 8 of the trench, toward the bucket body, between the walls 6.

Moreover, as a result of the respective positions of the ends 21 and 22 of the rocker arms 20, the pivoting of the levers 9 about the axes 10 causes the ram 16 to rise, thus freeing the interior of the bucket body.

The rocker arms 20 also assure the synchronization of the levers 9. As a matter of fact, since the hydraulic cylinders 15 operate independently of each other, one lever 9 could, in heterogeneous terrain, be restricted more than the other, causing an imbalance of the bucket.

When the bucket is closed, the lateral walls of the scoops extend from the lateral walls 6 of the bucket body, and the leading edges of the scoops carrying the picks 23 meet in proximity to the knife-edge 7.

The opening of the bucket takes place in inverse sequence, also in two phases, the ram 16 helping to eject the cuttings from the bucket body 5.

A sequence valve (not shown) can be provided to automatically control the operating sequence of the cylinders 11 and 15.

Various modifications and variations can of course be applied to the preceding description, without, however, departing from either the scope or the spirit of the invention.

Thus, in particular, in addition to the ram 16, cuttings-ejectors could also be installed in the scoops 13.

I claim:

1. An excavating bucket apparatus including two scoops mounted for movement with respect to a frame from an open terrain-engaging position to a closed position in which said scoops enclose cuttings, characterized by the fact that said apparatus includes a central bucket body means integral with said frame and having at least two lateral walls, support levers associated with each scoop, for mounting said scoops pivotally on said frame; closing means being provided to cause, when the bucket apparatus is in said closed position, a rotation of the scoops with respect to their support levers during a first phase, and to cause during a second phase, a rotation of the levers with respect to the frame, said scoops being arranged so that, in said closed position, they approach the central body from both directions with their lateral walls extending from the lateral walls of the central body.

2. Excavating bucket apparatus according to claim 1 characterized by the fact that the central body includes at its lower part a knifeedge means forming a brace between its two lateral walls, the scoops being arranged so that in said closed position their leading edges meet in the vicinity of said knife-edge means.

3. Excavating bucket apparatus to claim 1 characterized by the fact that said closing means includes, for each scoop, a first cylinder mounted between the frame and the end of the respective lever opposite to axis of rotation of the scoop, and a second cylinder mounted between the lever and the scoop.

4. Excavating bucket apparatus according to claim 1 characterized by the fact that it includes ejection ram means, slide support means arranged to accommodate sliding support of said ram means from a high position when the bucket is closed, to a low position, in the interior of the central body, when the bucket apparatus is open.

5. Excavating bucket apparatus according to claim 4, characterized by the fact that it includes at least one rocker arm means of which a first end is mounted on one of said levers and of which the second end is mounted on said ejection ram means, so as to cause the ram means to rise when the lower part of said lever pivots in the direction of the central body during closing of the bucket apparatus.

6. Excavating bucket according to claim 5, characterized by the fact that said rocker arm means has it first end mounted at the lower part of said lever and has its second end mounted on said ejection ram means at a point situated above the first end when the bucket apparatus is open and with the ram means in said low position.

* * * * *